US011326452B1

(12) United States Patent
Cao et al.

(10) Patent No.: US 11,326,452 B1
(45) Date of Patent: May 10, 2022

(54) SIMILAR SIMULATION EXPERIMENTAL DEVICE OF HYDRAULIC ENERGY-ABSORBING ROADWAY SUPPORT

(71) Applicant: China University of Mining and Technology, Xuzhou (CN)

(72) Inventors: Anye Cao, Xuzhou (CN); Yaoqi Liu, Xuzhou (CN); Chengchun Xue, Xuzhou (CN); Guifeng Wang, Xuzhou (CN); Geng Li, Xuzhou (CN); Wu Cai, Xuzhou (CN); Siyuan Gong, Xuzhou (CN); Linming Dou, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 17/524,992

(22) Filed: Nov. 12, 2021

(30) Foreign Application Priority Data

Dec. 7, 2020 (CN) ..... 202011418022.1

(51) Int. Cl.

| | |
|---|---|
| ***E21D 9/14*** | (2006.01) |
| ***E21F 17/00*** | (2006.01) |
| ***E21D 23/16*** | (2006.01) |
| ***E21D 15/44*** | (2006.01) |
| ***E21D 23/04*** | (2006.01) |

(52) U.S. Cl.
CPC ..... *E21D 9/14* (2013.01); *E21D 15/44* (2013.01); *E21D 23/04* (2013.01); *E21D 23/16* (2013.01); *E21F 17/00* (2013.01)

(58) Field of Classification Search
CPC . E21F 11/00; E21F 17/00; E21F 17/18; E21F 17/185; E21D 9/14; E21D 15/44; E21D 15/46; E21D 23/04; E21D 23/16
USPC ..... 299/11, 12
See application file for complete search history.

(56) References Cited

U.S. PATENT DOCUMENTS

2021/0134135 A1* 5/2021 He ..... E21F 17/18

FOREIGN PATENT DOCUMENTS

| | | | | |
|---|---|---|---|---|
| CN | 105179018 A | * | 12/2015 | ..... E21F 17/18 |
| CN | 105822319 A | * | 8/2016 | |
| CN | 109184793 A | * | 1/2019 | ..... E21D 20/00 |
| CN | 111911209 A | * | 11/2020 | ..... E21F 17/18 |
| CN | 112253163 A | * | 1/2021 | |
| CN | 113279813 A | * | 8/2021 | |

* cited by examiner

*Primary Examiner* — Frederick L Lagman
(74) *Attorney, Agent, or Firm* — WPAT, PC

(57) ABSTRACT

A similar simulation experimental device of hydraulic energy-absorbing roadway support is provided. A similar model is placed in a model box, a roadway is excavated in the similar model, and hydraulic energy-absorbing support devices are placed in the roadway on the periphery of the roadway. Front and rear ends of the hydraulic energy-absorbing support device are connected to supporting plates, left and right sides of the model box are provided with horizontal hydraulic cylinders, and front ends of the horizontal hydraulic cylinders are connected to pressure plates. One or several cushion blocks are placed at the top of the model box, and an upper pressure plate is placed above the cushion block(s). Vertical hydraulic cylinders are installed at both ends of the upper pressure plate. An impact rod passing through the upper pressure plate is placed above the cushion block to apply vertical impact load to the similar model.

5 Claims, 3 Drawing Sheets

SIMILAR SIMULATION EXPERIMENTAL DEVICE OF HYDRAULIC ENERGY-ABSORBING ROADWAY SUPPORT

TECHNICAL FIELD

The invention relates to a mine safety technology, especially a mine roadway safety technology, in particular to a similar simulation experimental device of hydraulic energy-absorbing roadway support.

BACKGROUND

Rock burst is a dynamic phenomenon that coal (rock) around mine or working face causes sudden and violent destruction due to the instantaneous release of elastic deformation energy, which is often accompanied by coal and rock throwing, loud noise and air billow, and is a coal mine power disaster that causes casualties and serious damage to mining space. At present, a considerable part of rock burst can't be predicted in advance, especially when the energy accumulated in the coal and rock structure system is not huge. However, when the coal and rock structure is suddenly affected by the dynamic load caused by roof breakage, fault slip, blasting, etc., a large rock burst disaster can occur before predicting and preventing measures are taken. Reasonable design of energy-absorbing and anti-impact support can improve the anti-seismic and anti-impact ability of the roadway, significantly reduce the probability of rock burst triggered by mine earthquake, and effectively reduce the intensity of impact and the losses caused by disasters.

At present, the mechanism of energy-absorbing support is still unclear, and there is a lack of effective energy-absorbing support design theory for rock burst roadway. The main reason is that rock burst is unexpected and it is difficult to carry out field study, while the laboratory lacks effective experimental research equipment and methods.

SUMMARY

A purpose of the invention is to design a similar simulation experimental device of hydraulic energy-absorbing roadway support, aiming at the problems that the mechanism of energy-absorbing support can not be deeply studied due to the lack of an effective experimental device for energy-absorbing roadway support of rock burst at present, which leads to mine safety accidents happen from time to time.

The technical scheme of the invention may be as follows:

Specifically, for a similar simulation experimental device of hydraulic energy-absorbing roadway support, a similar model 2 is placed inside a model box 1, and a roadway 3 is excavated inside the similar model; a plurality of hydraulic energy-absorbing support devices 4 are placed in the roadway 3 on the periphery of the roadway, and the front and rear ends of the hydraulic energy-absorbing support device 4 are fixedly connected to supporting plates 5; the left and right sides of the model box 1 are provided with horizontal hydraulic cylinders 6, and the front ends of the horizontal hydraulic cylinders 6 are connected to pressure plates 7, and the pressure plates 7 abut against the similar model 2 and configured (i.e., structured and arranged) to apply horizontal static load to the similar model 2; one or several cushion blocks 8 are placed on the top of the model box 1, and an upper pressure plate 10 is placed above the one or several cushion blocks 8; two ends of the upper pressure plate 10 are provided with vertical hydraulic cylinders 11, and the upper pressure plate 10 is configured to apply vertical static load to the similar model 2 through the one or several cushion blocks 8; an impact rod 9 passing through the upper pressing plate 10 is placed above the cushion block 8, and the impact rod 9 is configured to receive external impact load 12 so as to apply impact load in the vertical direction to the similar model 2; oil guide plates 42 are respectively installed on the front and rear of a base body 41 of each the hydraulic energy-absorbing support device 4, and the oil guide plate 42 is connected to a support hydraulic cylinder 44 through an internal oil guide hole 43; the front end of the support hydraulic cylinder 44 is provided with a pressure sensor 45 which is placed in a protruding groove 47 of a supporting frame 46; two oil guide plates 42 of each the hydraulic energy-absorbing support device 4 are respectively connected to independent oil inlet and return lines 14 through internal oil guide holes 43, and the oil inlet and return lines 14 are connected to a reversing valve 15, and a valve port of the reversing valve 15 is connected to the oil inlet line 16 and an accumulator 17; the front end of the oil inlet line 16 is provided with a pressure reducing valve 18; the front end of the pressure reducing valve 18 is connected to a one-way valve 19, which is connected to a hydraulic pump station 20.

In an embodiment, transparent baffles 13 are arranged in front of and behind the model box 1, and the transparent baffles 13 are fixed on the model box 1 or abut against the model box 1 under the action of hydraulic cylinders 21.

In an embodiment, in the roadway 3, the plurality of hydraulic energy-absorbing support devices 4 support different parts on the surface of the roadway 3 on the periphery of the roadway.

In an embodiment, the two oil guide plates 42 of the hydraulic energy-absorbing support device 4 are connected to independent accumulators 17, which are the same or different.

In an embodiment, the accumulators 17 connected to the hydraulic energy-absorbing supporting devices 4 at different parts of the cross-section of the roadway 3 are the same or different.

The invention may have the following beneficial effects:

The invention utilizes a similar simulation experimental device of hydraulic energy-absorbing roadway support, so that an initial supporting force can be applied to the roadway by a hydraulic cylinder in the laboratory, and a hydraulic impact caused by roadway vibration can be absorbed by an accumulator. By studying the characteristics of vibration and impact damage of roadway model under dynamic and static load, the mechanism of energy-absorbing roadway support is revealed, and the magnitude of energy-absorbing support of different forms against mine earthquake dynamic load is determined, thus forming a sound theory and method of energy-absorbing support of anti-impact support, which provides a scientific theoretical basis for energy-absorbing support design of roadway under rock burst.

DETAILED DESCRIPTION OF EMBODIMENTS

The invention will be further explained with reference to the figures and the embodiment.

Figure 1:
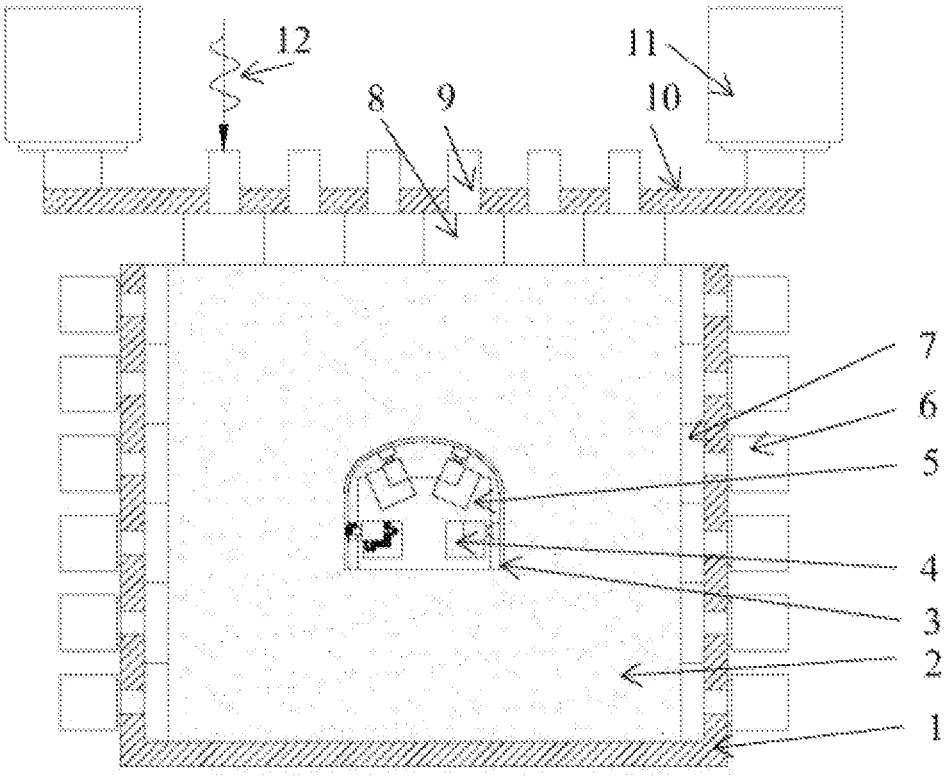
FIG. 1 is a schematic structural diagram of a hydraulic experimental device of the invention.
Figure 2:
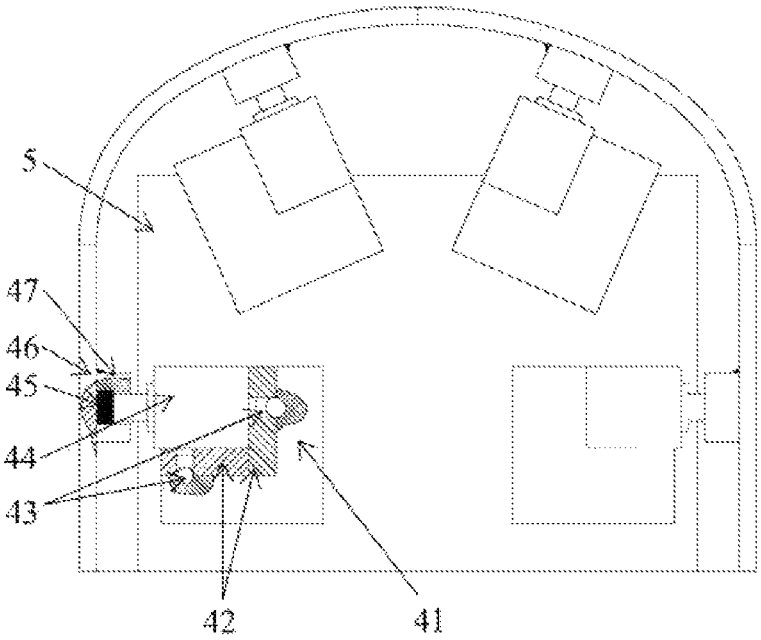
FIG. 2 is a schematic diagram of the measurement structure inside the roadway support of the invention.
Figure 3:
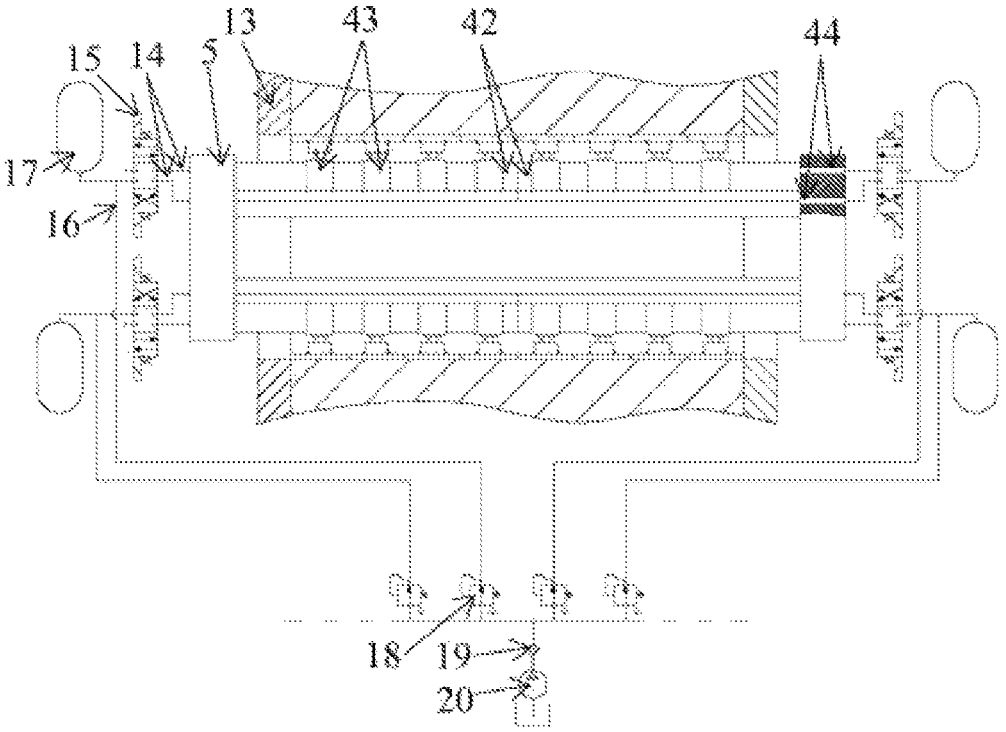
FIG. 3 is a schematic diagram of spindle loading of the invention.
Figure 4:
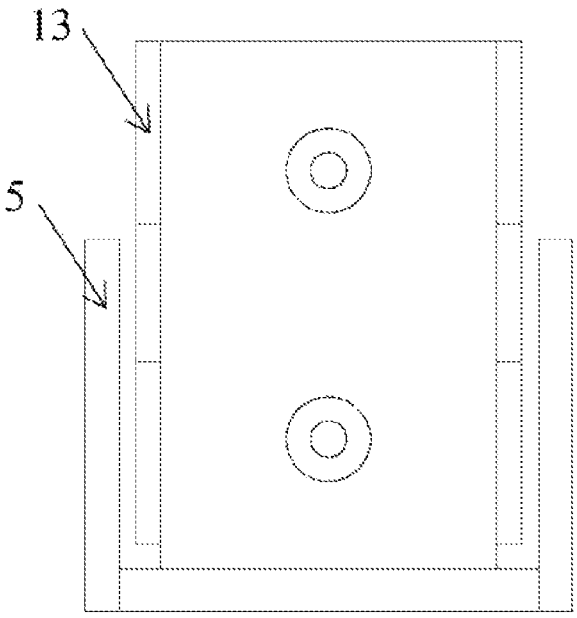
FIG. 4 is one of the schematic diagrams of the installation structure of supporting plates at both ends of the roadway of the invention.
Figure 5:
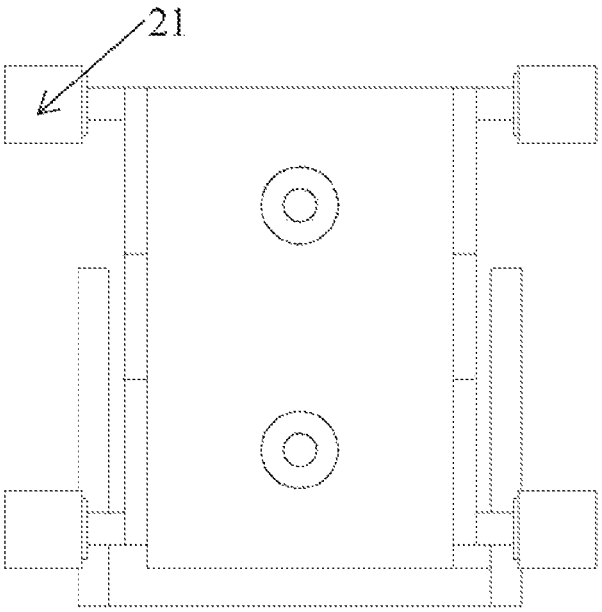
FIG. 5 is the other schematic diagram of the installation structure of supporting plates at both ends of the roadway of the invention.

As shown in FIGS. 1-5:

A similar simulation experimental device of hydraulic energy-absorbing roadway support, which comprises a model box 1, a similar model 2 and a roadway 3. As shown in FIG. 1, the similar model 2 is placed inside the model box 1, and the roadway 3 is excavated inside the similar model 2. A plurality of (i.e., more than one) hydraulic energy-absorbing support devices 4 are placed on the roadway periphery in the roadway 3 to receive and bear the horizontal static load and the vertical static or dynamic load borne by the similar model 2. The front and rear ends of the hydraulic energy-absorbing support device 4 are fixedly connected with supporting plates 5, as shown in FIGS. 4 and 5; horizontal static load is provided by horizontal hydraulic cylinders 6 installed on the left and right sides of the model box 1. The front ends of the horizontal hydraulic cylinder 6 are connected to pressure plates 7, and the pressure plate 7 abuts against the similar model 2 and applies horizontal static load to the similar model 2; the vertical static or dynamic load is transmitted by one or several cushion blocks 8 placed on the top of the model box 1. An upper pressure plate 10 is placed above the cushion blocks 8, and vertical hydraulic cylinders 11 generating static load are installed at both ends of the upper pressure plate 10; the upper pressure plate 10 applies vertical static load to the similar model 2 through the cushion blocks 8; an impact rod 9 passing through the upper pressure plate 10 is placed above the cushion block 8, and the impact rod 9 receives an external impact load 12 so as to apply a vertical impact load to the similar model 2; the structure of the hydraulic energy-absorbing support device 4 is shown in FIG. 2 and FIG. 3, and it includes a base body 41, on which oil guide plates 42 are respectively installed at the front and rear, and the oil guide plate 42 is connected to a support hydraulic cylinder 44 through an internal oil guide hole 43, and a pressure sensor 45 is placed at the front end of the support hydraulic cylinder 44; the pressure sensor 45 is specifically placed in a protruding groove 47 of a supporting frame 46. Two oil guide plates 42 of each hydraulic energy-absorbing support device 4 are respectively connected to independent oil inlet and return lines 14 through internal oil guide holes 43, and the oil inlet and return lines 14 are connected to a reversing valve 15, and a valve port of the reversing valve 15 is connected to an oil inlet line 16 and an accumulator 17; the front end of the oil inlet line 16 is provided with a pressure reducing valve 18; the front end of the pressure reducing valve 18 is connected to a one-way valve 19, which is connected to a hydraulic pump station 20. The loading and unloading of the inner wall of the roadway can be realized by the action of the reversing valve 15; when loading, relevant experiments can be carried out and a basic pressure can be generated; when loading is carried out, the pressure sensor 45 will measure the squeezing force or impacting force on the inner wall of the roadway according to the external loading force, and the experimental data can be obtained by the corresponding pressure sensor 45. Transparent baffles 13 are arranged at the front and back of the model box 1, and the transparent baffles 13 are fixed on the model box 1 or abut against the model box 1 under the action of hydraulic cylinders 21. A plurality of hydraulic energy-absorbing support devices 4 in the roadway 3 support different parts of the surface of the roadway 3 on the periphery of the roadway. The two oil guide plates 42 of the hydraulic energy-absorbing support device 4 are connected to the independent accumulators 17, which are the same or different. The accumulators 17 connected to the hydraulic energy-absorbing support devices 4 at different parts of the cross-section of the roadway 3 are the same or different.

The part not involved in the invention is the same with the prior art or can be realized by adopting the prior art.

What is claimed is:

1. A similar simulation experimental device of hydraulic energy-absorbing roadway support, wherein a similar model (2) is placed inside a model box (1), and a roadway (3) is excavated inside the similar model; a plurality of hydraulic energy-absorbing support devices (4) are placed in the roadway (3) along a periphery of the roadway (3), and front and rear ends of each of the plurality of hydraulic energy-absorbing support devices (4) are fixedly connected to supporting plates (5); left and right sides of the model box (1) are provided with horizontal hydraulic cylinders (6), and front ends of the horizontal hydraulic cylinders (6) are connected to pressure plates (7), and the pressure plates (7) abut against the similar model (2) and configured to apply horizontal static load to the similar model (2); one or more cushion blocks (8) are placed on a top of the model box (1), an upper pressure plate (10) is placed above the one or more cushion blocks (8); two ends of the upper pressure plate (10) are provided with vertical hydraulic cylinders (11), and the upper pressure plate (10) is configured to apply vertical static load to the similar model (2) through the one or more cushion blocks (8); an impact rod (9) passing through the upper pressing plate (10) is placed above the cushion block (8), and the impact rod (9) is configured to receive external impact load (12) so as to apply impact load in the vertical direction to the similar model (2); two oil guide plates (42) are respectively installed on front and rear of a base body (41) of each of the plurality of hydraulic energy-absorbing support devices (4), and the oil guide plates (42) are connected to a support hydraulic cylinder (44) through internal oil guide holes (43); a front end of the support hydraulic cylinder (44) is provided with a pressure sensor (45) which is placed in a protruding groove (47) of a supporting frame (46); the two oil guide plates (42) of each of the plurality of hydraulic energy-absorbing support devices (4) are respectively connected to independent oil inlet and return lines (14) through the internal oil guide holes (43), and the oil inlet and return lines (14) are connected to a reversing valve (15), and a valve port of the reversing valve (15) is connected to the oil inlet line (16) and an accumulator (17); a front end of the oil inlet line (16) is provided with a pressure reducing valve (18); a front end of the pressure reducing valve (18) is connected to a one-way valve (19), and the one-way valve (19) is connected to a hydraulic pump station (20).

2. The similar simulation experimental device of hydraulic energy-absorbing roadway support according to claim 1, wherein transparent baffles (13) are arranged in front of and behind the model box (1), and the transparent baffles (13) are fixed on the model box (1) or abut against the model box (1) under actions of hydraulic cylinders (21).

3. The similar simulation experimental device of hydraulic energy-absorbing roadway support according to claim 1, wherein in the roadway (3), the plurality of hydraulic energy-absorbing support devices (4) support different parts on a surface of the roadway (3) along the periphery of the roadway (3).

4. The similar simulation experimental device of hydraulic energy-absorbing roadway support according to claim 1, wherein the two oil guide plates (42) of each of the plurality of hydraulic energy-absorbing support devices (4) are connected to independent accumulators (17) being the same or different from each other.

5. The similar simulation experimental device of hydraulic energy-absorbing roadway support according to claim 1, wherein the accumulators (17) connected to the plurality of hydraulic energy-absorbing supporting devices (4) at different parts of a cross-section of the roadway (3) are the same or different from one another.

* * * * *